US009512685B2

(12) United States Patent
Nguy et al.

(10) Patent No.: US 9,512,685 B2
(45) Date of Patent: Dec. 6, 2016

(54) CABLE PROTECTOR SYSTEM

(71) Applicant: Schlumberger Technology Corporation, Sugar Land, TX (US)

(72) Inventors: Vi Van Nguy, Shanghai (CN); Zhong Shen, Shanghai (CN); Xue Feng Wang, Shanghai (CN)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/823,960

(22) Filed: Aug. 11, 2015

(65) Prior Publication Data

US 2016/0053555 A1 Feb. 25, 2016

Related U.S. Application Data

(60) Provisional application No. 62/067,760, filed on Oct. 23, 2014, provisional application No. 62/039,186, filed on Aug. 19, 2014.

(51) Int. Cl.
*E21B 17/10* (2006.01)
*E21B 17/00* (2006.01)

(52) U.S. Cl.
CPC ..... *E21B 17/1035* (2013.01); *E21B 17/006* (2013.01); *E21B 17/10* (2013.01)

(58) Field of Classification Search
CPC .... E21B 17/006; E21B 17/10; E21B 17/1035; E21B 19/00
USPC ..... 166/378
See application file for complete search history.

(56) References Cited

U.S. PATENT DOCUMENTS 2,437,751 A * 3/1948 Mitchell ..... F16B 39/34 29/523
2,923,340 A * 2/1960 Williams ..... F16B 39/24 411/133
3,410,613 A * 11/1968 Kuus ..... E21B 17/105 175/325.7
5,379,836 A * 1/1995 Jordan ..... E21B 17/1035 166/241.6
6,023,027 A * 2/2000 Neff ..... E21B 17/1035 138/110
6,283,205 B1 * 9/2001 Cannon ..... E21B 17/105 166/241.1
6,571,046 B1 * 5/2003 Hickey ..... E21B 17/003 385/134

(Continued)

FOREIGN PATENT DOCUMENTS

GB 2377717 A * 1/2003 ..... E21B 17/026
NO GB 2509116 A * 6/2014 ..... E21B 17/1035
VG GB 2398807 A * 9/2004 ..... E21B 17/1035

*Primary Examiner* — Matthew R Buck
(74) *Attorney, Agent, or Firm* — David J. Groesbeck

(57) ABSTRACT

A technique provides a cable protector in the form of a modular unit having a protector shell and at least one removable insert. The removable insert is constructed with gaps which are sized to grippingly engage a cable. Accordingly, a properly sized removable insert is selected for use with a given cable and then inserted into the protector shell. The cable protector may then be secured to a tubing, e.g. a well tubing, by an appropriate tubing coupling. In some embodiments, the tubing coupling is coupled about the tubing via a threaded fastener which may be held in place by a back off preventer.

14 Claims, 8 Drawing Sheets

(56) References Cited

U.S. PATENT DOCUMENTS

| | | | | |
|---|---|---|---|---|
| 6,588,714 | B2 * | 7/2003 | Blane | E21B 17/1035 248/67.5 |
| 6,755,595 | B2 * | 6/2004 | Oram | E21B 17/01 114/243 |
| 6,821,055 | B2 * | 11/2004 | Oram | B63B 43/14 166/350 |
| 7,214,114 | B2 * | 5/2007 | Gibson | E21B 17/012 441/133 |
| 7,431,535 | B2 * | 10/2008 | Cupolillo | E21B 17/1035 166/241.1 |
| 7,628,665 | B1 * | 12/2009 | Cook | E21B 17/012 405/195.1 |
| 8,690,481 | B2 * | 4/2014 | Begley | E21B 17/012 405/195.1 |
| 8,752,633 | B2 * | 6/2014 | Whitelaw | E21B 17/1035 138/110 |
| 8,875,792 | B2 * | 11/2014 | Whitelaw | E21B 17/1035 166/345 |

* cited by examiner

CABLE PROTECTOR SYSTEM

CROSS-REFERENCE TO RELATED APPLICATIONS

The present document is based on and claims priority to U.S. Provisional Application Ser. No. 62/067,760, filed Oct. 23, 2014, and to U.S. Provisional Application Ser. No. 62/039,186, filed Aug. 19, 2014 which are incorporated herein by reference in their entirety.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components may be installed to control and enhance the efficiency of producing various fluids from the reservoir. For example, electric submersible pump (ESP) systems are deployed downhole to pump the fluids to a surface location or other collection location. ESP systems and other completion related components and systems may be controlled via inputs provided through a cable routed downhole along the completion. The cable may comprise a variety of conduits, electrical conductors, hydraulic control lines, and/or other types of communication lines.

The structural integrity of the cable may be preserved by employing cable protectors along the completion equipment. The cable protectors are used to protect the cable from damage during deployment downhole and to prevent relative movement between the cable and the corresponding completion string. Cable protectors are constructed to engage the specific dimensions of a given cable and to thus trap the cable and prevent axial movement of the cable relative to the completion tubing. Accordingly, each size and configuration of cable uses a specifically designed cable protector to provide a proper fit. To ensure a strong and properly fitted cable protector, the body of the cable protector often is constructed as a single integral casting. However, this type of casting process employs a specific mold for each specific cable protector body, thus adding substantial complexity and time to the cable protector manufacturing process.

SUMMARY

In general, a system and methodology are provided in which a cable protector is a modular unit having a protector shell and at least one removable insert. The removable insert is constructed with gaps which are sized to grippingly engage a cable. Accordingly, a properly sized removable insert is selected for use with a given cable and then inserted into the protector shell. The cable protector may then be secured to a tubing, e.g. a well tubing, by an appropriate tubing coupling. In some embodiments, the cable protector is coupled about the tubing via a threaded fastener which may be held in place by a back off preventer.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which employ a modular cable protector. The modular cable protector has a protector shell and at least one removable insert. The removable insert is constructed with gaps which are sized to grippingly engage a cable. The removable inserts may be formed by casting, molding, forging, or by other suitable techniques to provide the appropriately sized gaps between extensions. The extensions are spaced to properly grip the cable or cables held by the modular cable protector. The extensions and corresponding gaps are constructed based on the size and/or type of cable or cables so as to provide the desired balance between loose fitting and tight fitting when each cable is received in the cable protector.

Accordingly, a properly sized removable insert is selected for use with a given cable and then inserted into the protector shell. Sometimes the shell may be constructed so two or more of the removable inserts can be inserted into the protector shell. By way of example, the protector shell may have slots or other features positioned to receive and hold the removable inserts when the cable protector is placed into service. The protector shell provides a tough protective shroud for the cables, e.g. conduits, during deployment and use in, for example, a wellbore. After insertion of the desired removable insert(s), the cable protector may be secured to a tubing, e.g. a well tubing, by an appropriate tubing coupling. In some embodiments, the tubing coupling is coupled about the tubing via a threaded fastener which may be held in place by a back off preventer.

Figure 1:
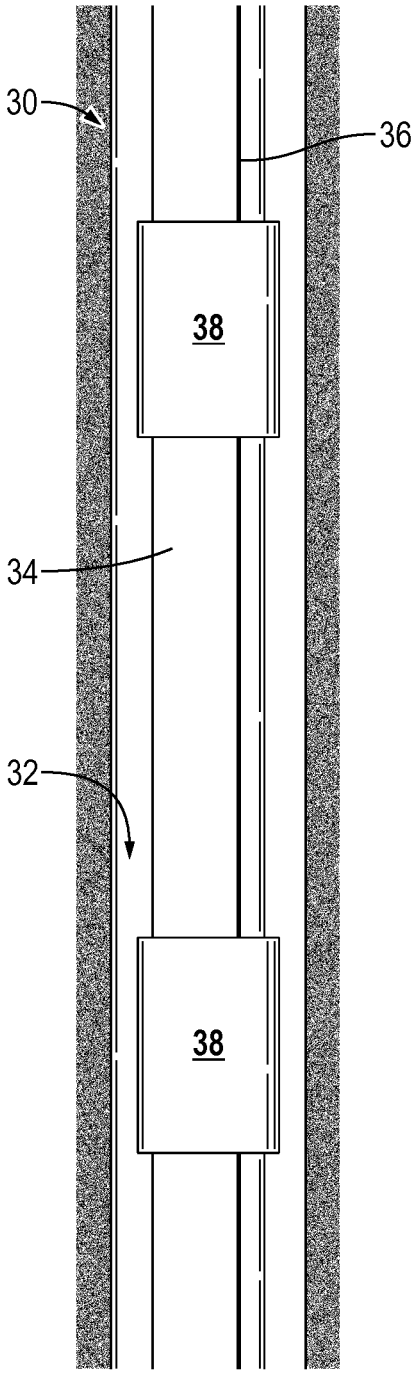
FIG. 1 is an illustration of a well system deployed in a wellbore and comprising a plurality of cable protectors, according to an embodiment of the disclosure.

Referring generally to FIG. 1, an embodiment of a well system 30 is illustrated as deployed in a wellbore 32. The well system 30 comprises well tubing 34, e.g. completion tubing, and a cable or cables 36 deployed along the well tubing 34. Additionally, the well system 30 comprises at least one and often a plurality of cable protectors 38 secured to the well tubing 34. The cable protectors 38 are in the form of modular cable protectors which may be easily adapted to different types, sizes, and/or numbers of cables 36 by interchanging removable inserts as discussed in greater detail below.

Figure 2:
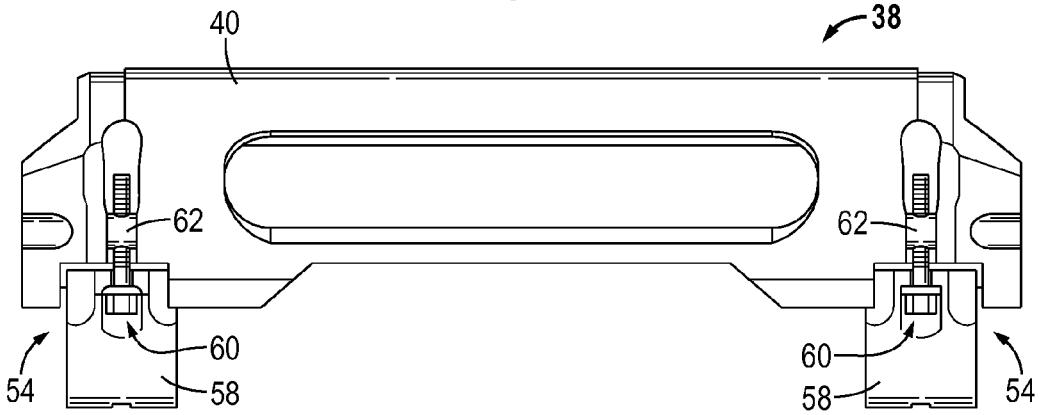
FIG. 2 is an illustration of an example of a cable protector having at least one removable insert, according to an embodiment of the disclosure.
Figure 3:
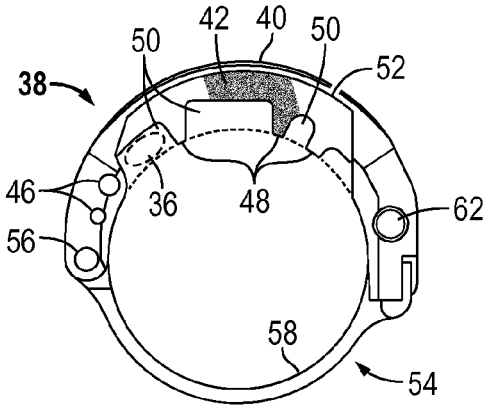
FIG. 3 is an end view of the cable protector illustrated in FIG. 2, according to an embodiment of the disclosure.
Figure 4:
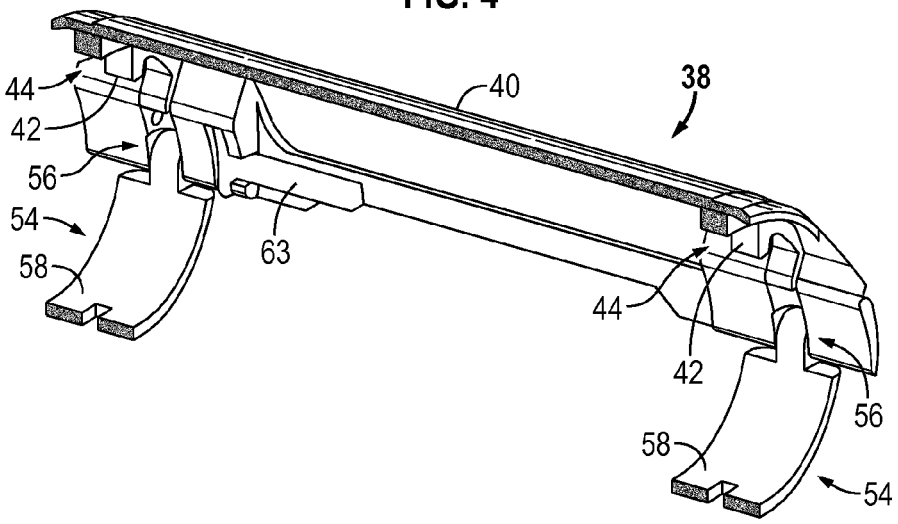
FIG. 4 is a sectional view of the cable protector illustrated in FIG. 2, according to an embodiment of the disclosure.

Referring generally to FIGS. 2-4, an embodiment of one of the cable protector 38 is illustrated. In the example illustrated, the cable protector 38 comprises a protector shell 40 constructed to be positioned over the cable or cables 36. The cable protector 38 also comprises a removable insert 42 positioned within the protector shell 40 (see FIG. 3). In some applications, a plurality of the removable inserts 42 may be positioned within the protector shell 40. By way of example, the removable insert 42 may be received in a corresponding slot 44 (see FIG. 4) formed in the protector shell 40. Depending on the application, the removable insert 42 also may be secured to the protector shell 40 by a fastener or fasteners 46, e.g. threaded fasteners. The fastener(s) 46 are useful for ensuring that the removable insert 42 remains fixed to the protector shell 40 during transportation and storage.

The removable insert or inserts 42 may have a variety of configurations. As illustrated in FIG. 3, the removable insert 42 may comprise a plurality of extensions 48 which define at least one gap 50 therebetween. The extensions 48 may extend inwardly, e.g. radially inwardly, from a base portion 52 of the insert 42. In the embodiment illustrated, the number of extensions 48 is selected to define a plurality of the gaps 50. The spacing of the extensions 48 and the size of the corresponding gaps 50 are selected to provide a desired gripping force against the cable 36 when received in the removable insert 42. The gripping force applied by extensions 48 to the cable 36 may vary according to whether the cable 36 comprises electrical lines, optical fiber lines, hydraulic control lines, conduits, and/or other types of signal communication lines.

The cable protector 38 further comprises a tubing coupling 54 to secure the protector shell 40 to the well tubing 34. In some applications, the tubing coupling 54 is constructed in the form of a pair of tubing couplings 54 positioned at opposite longitudinal ends of the protector shell 40. By way of example, each tubing coupling 54 may be pivotably attached to protector shell 40 via a pivot 56, e.g. a pivot pin. The pivot 56 allows a body 58 of the tubing coupling 54 to be pivoted about the well tubing 34 and secured via a fastener 60, e.g. a threaded fastener which is threadably received in a corresponding threaded region 62 of the protector shell 40 (see FIG. 2). In some applications, a coupling insert 63 may be used to maintain a desired gap between a tubing coupling located along well tubing 34 and portions of the cable protector 38.

Figure 5:
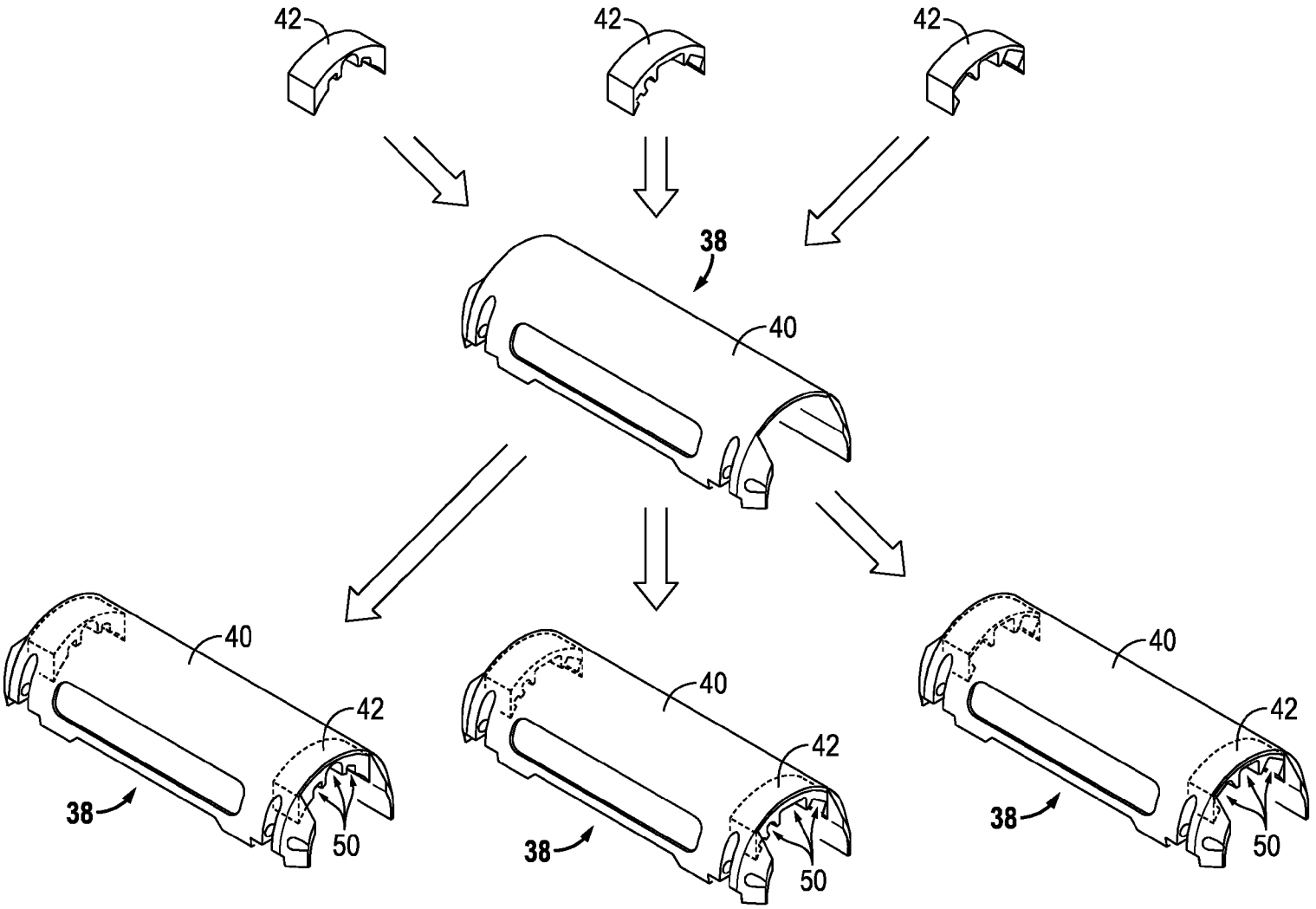
FIG. 5 is an illustration showing the modularity of the cable protector in which a plurality of different removable inserts may be selected for use with a protector shell, according to an embodiment of the disclosure.

Referring generally to FIG. 5, an illustration is provided to demonstrate the modularity of each cable protector 38. As illustrated along the top portion of FIG. 5, a plurality of different removable inserts 42 may be constructed for insertion into a single protector shell 40. Each of the different configurations of removable insert 42 may be inserted into the same protector shell 40, as illustrated along the bottom portion of FIG. 5. This allows an operator to easily match a desired removable insert 42 with the cable or cables 36 which are to be routed along the well tubing 34. The selected insert(s) 42 are then slid into the protector shell 40; the cable or cables 36 are grippingly received in the appropriate corresponding gaps 50 between extensions 48; and the cable protector 38 is secured to the well tubing 34 via tubing couplings 54. If a different cable 36 is to be used, the cable protector 38 may simply be released so that the removable insert 42 may be interchanged with another removable insert 42 suited to the size and type of the different cable 36. The cable protector 38 may then be reattached to the well tubing 34.

In some embodiments, a back off preventer mechanism may be used to prevent loosening and inadvertent removal of the threaded fastener 60 under, for example, impact and/or vibration loading. By way of example, the back off preventer mechanism may comprise a mechanical mechanism for mechanically retaining the threaded fastener 60. Depending on the application, the back off preventer mechanism may be affixed to the threaded fastener 60 or may be a separate component engageable with the threaded fastener 60, as discussed in greater detail below.

Figure 6:
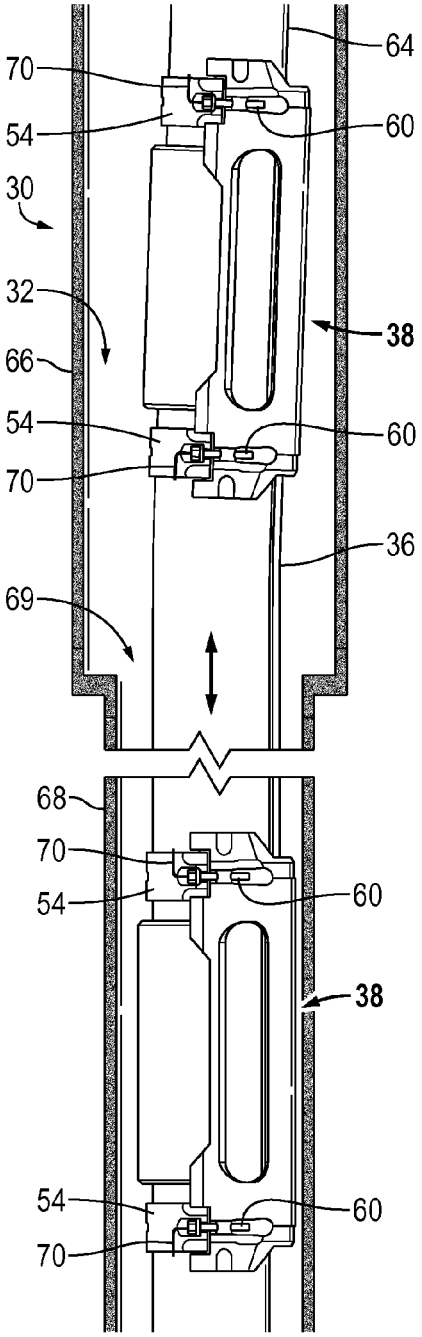
FIG. 6 is an illustration of a well system being deployed with cable protectors in which the cable protectors are protected against premature loosening or release, according to an embodiment of the disclosure.

Referring generally to FIG. 6, another embodiment of well system 30 is illustrated as a subsea completion string 64 disposed inside a riser 66 and casing 68. In this type of application, there is potential for cyclical loading, e.g. impact and/or vibration loading, on the cable protectors 38 as the cable protectors 38 pass through certain sections of the wellbore 32, e.g. a transition section 69 between the riser 66 and the well casing 68. The cyclical loading may be due to the motion of ocean waves on the surface and/or misalignment of the completion string. Such loading can sometimes lead to loosening of the threaded fasteners 60 without incorporation of a back off preventer 70.

Figure 7:
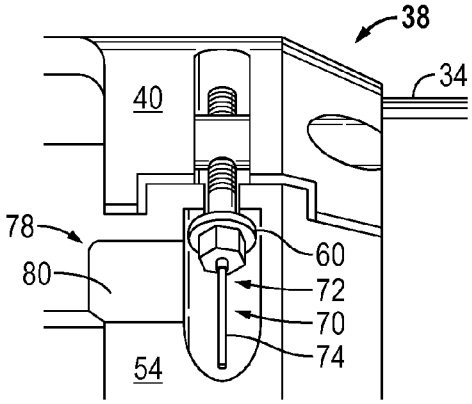
FIG. 7 is an illustration of a portion of one of the cable protectors illustrated in FIG. 6 showing a threaded fastener for securing the cable protector and a back off preventer which prevents loosening of the threaded fastener, according to an embodiment of the disclosure.
Figure 8:
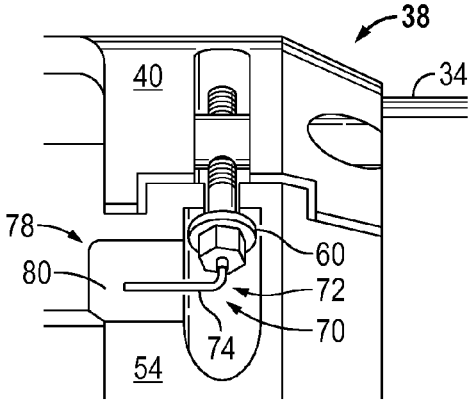
FIG. 8 is an illustration similar to that of FIG. 7 but showing the back off preventer in an activated position, according to an embodiment of the disclosure.
Figure 9:
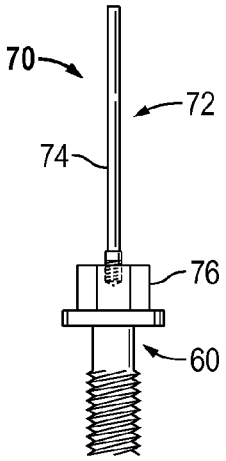
FIG. 9 is a cross-sectional view of an example of a threaded fastener with a back off preventer, according to an embodiment of the disclosure.

An example of back off preventer 70 is illustrated in FIGS. 7-9. In this embodiment, the back off preventer 70 comprises a malleable feature 72 which may be deformed to prevent loosening of the corresponding threaded fastener 60. By way of example, the malleable feature 72 may comprise a malleable retaining tail 74 coupled to a head 76 of threaded fastener 60 (see FIG. 9) or to another suitable portion of threaded fastener 60.

In an operational example, the corresponding cable protector 38 is secured to well tubing 34 via threaded fasteners 60, as illustrated in FIG. 7. The malleable retaining tail 74 is then bent into a recess 78 of the corresponding tubing coupling 54 or protector shell 40, as illustrated in FIG. 8. Once retaining tail 74 is disposed in the recess 78, an abutment wall 80 prevents lateral movement of the malleable retaining tail 74 and thus prevents loosening rotation of the corresponding threaded fastener 60. By way of example, the malleable retaining tail 74 may be threadably engaged and/or welded to head 76 of threaded fastener 60, as illustrated in FIG. 9.

Figure 10:
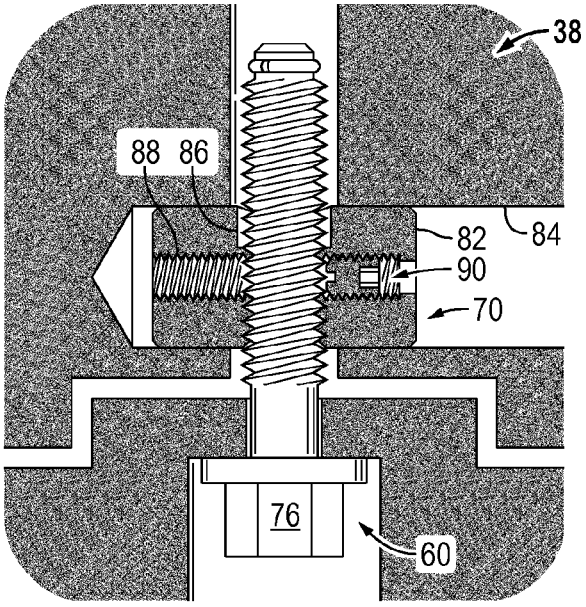
FIG. 10 is an illustration of another example of a back off preventer which may be employed to secure a threaded fastener of a cable protector, according to an embodiment of the disclosure.
Figure 11:
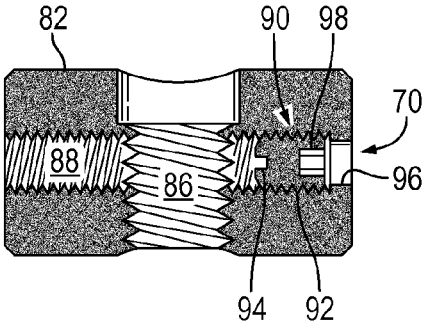
FIG. 11 is an illustration of the back off preventer shown in FIG. 10 prior to receiving the threaded fastener, according to an embodiment of the disclosure.
Figure 12:
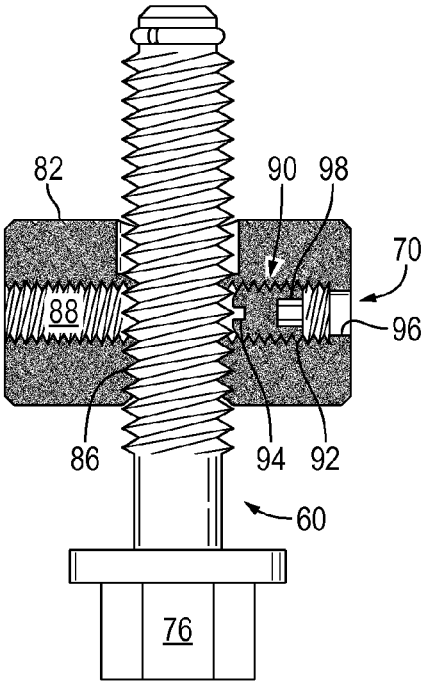
FIG. 12 is an illustration of the back off preventer shown in FIG. 10 after receiving the threaded fastener, according to an embodiment of the disclosure.

Referring generally to FIGS. 10-12, another embodiment of back off preventer 70 is illustrated. In this example, the back off preventer 70 comprises a barrel 82 received in a slot or recess 84 formed in the corresponding tubing coupling 54. The barrel 82 comprises a transverse passage 86 for receiving the threaded fastener 60 and a longitudinal passage 88 for receiving a setscrew 90.

During assembly, the setscrew 90 is moved into longitudinal passage 88 and threadably engaged with a corresponding threaded region 92 disposed along the longitudinal passage 88 of barrel 82. The setscrew 90 may include a tool feature 94 for receiving a tool, e.g. screwdriver, used to rotate the setscrew 90 and to thus move the setscrew 90 longitudinally along longitudinal passage 88 until engaged with an abutment 96, as illustrated in FIG. 11. The abutment 96 traps the setscrew 90 in longitudinal passage 88. At this stage, the barrel 82 may be inserted into recess 84 and the threaded fastener 60 may be inserted through the transverse passage 86 (see FIGS. 10 and 12). A second tool, e.g. a hex tool sometimes referred to as an Allen™ wrench, may then be inserted into the longitudinal passage 88 from an opposite end so as to engage an opposed tool feature 98. The tool feature 98 allows the second tool to rotate the setscrew 90 and to move the setscrew into firm, abutting engagement with a side of the threaded fastener 60, thus preventing loosening rotation of the threaded fastener 60.

Figure 13:
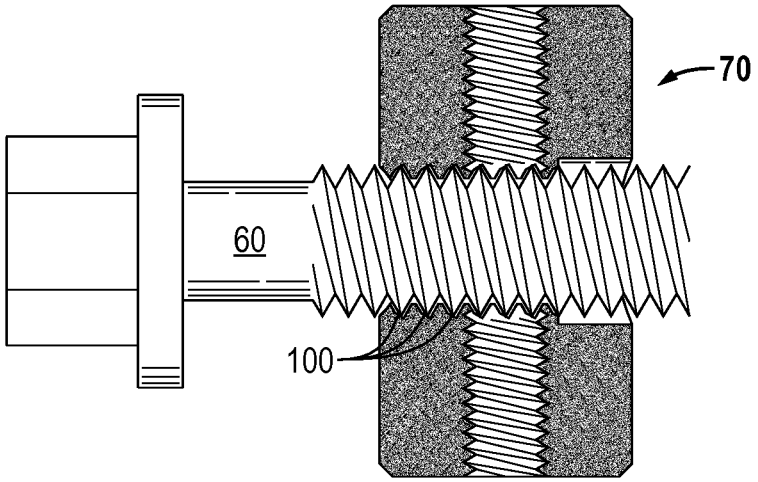
FIG. 13 is an illustration of another example of a back off preventer which may be used to secure threaded fasteners in a cable protector, according to an embodiment of the disclosure.
Figure 14:
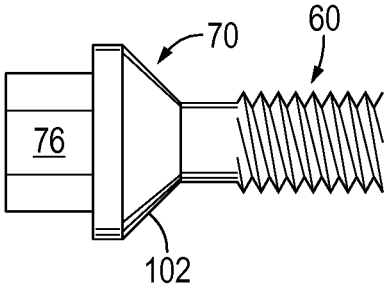
FIG. 14 is an illustration of another example of a back off preventer which may be used to secure threaded fasteners in a cable protector, according to an embodiment of the disclosure.

Depending on the application, the back off preventer 70 may be constructed in a variety of configurations. In some of these embodiments, the back off preventer 70 is constructed to increase frictional forces with respect to the threads and/or the head of the threaded fastener 60. As illustrated in FIG. 13, an example of such a back off preventer 70 comprises Spiralock™ threads 100 which are used along transverse passage 86 of barrel 82. Such threads are designed to provide a slight interference fit which increases friction and thus resists loosening of the threaded fastener 60. In another example, the back off preventer 70 is in the form of a conical surface 102 located on the head 76 of threaded fastener 60, as illustrated in FIG. 14. The conical surface 102 can be used to increase the contact area between the threaded fastener 60 and the corresponding portion of the cable protector 38 against which the threaded fastener 60 is tightened. In some applications, the conical surface 102 may be sandblasted or otherwise treated to increase the coefficient of friction and thus to further help prevent loosening of the threaded fastener 60.

Figure 15:
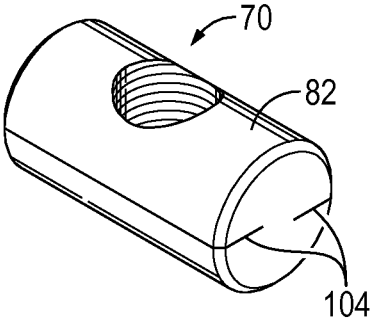
FIG. 15 is an illustration of another example of a back off preventer which may be used to secure threaded fasteners in a cable protector, according to an embodiment of the disclosure.
Figure 16:
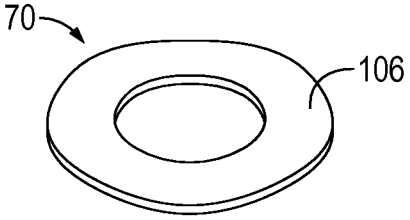
FIG. 16 is an illustration of another example of a back off preventer which may be used to secure threaded fasteners in a cable protector, according to an embodiment of the disclosure.
Figure 17:
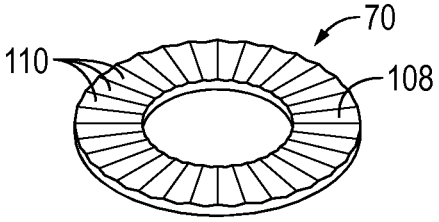
FIG. 17 is an illustration of another example of a back off preventer which may be used to secure threaded fasteners in a cable protector, according to an embodiment of the disclosure.

Referring generally to FIG. 15, another embodiment of back off preventer 70 is illustrated. In this example, the back off preventer 70 comprises slits 104 in the barrel 82. The split barrel 82 uses offset slits 104, e.g. two offset slits, to create a slight interference (or binding force) between the threaded fastener 60 and the barrel 82. The interference is provided to increase resistance against loosening of the threaded fastener 60 after securing the corresponding cable protector 38 to well tubing 34.

In other applications, the back off preventer 70 may comprise a variety of locking washers. By way of example, the back off preventer 70 may comprise a Belleville washer or washers 106 against which the head 76 is tightened during mounting of the cable protector 38 along well tubing 34. When the Belleville washers 106 are compressed, a loading is established against the threaded fastener 60 which helps prevent undesirable loosening of the threaded fastener 60. In another example, the back off preventer 70 may comprise a Nord Lock washer or washers 108 against which the head 76 is tightened. The Nord Lock washer 108 has teeth 110 oriented to bite into the head 76 of the threaded fastener 60 and to thus increase resistance against loosening of the threaded fastener 60.

Figure 18:
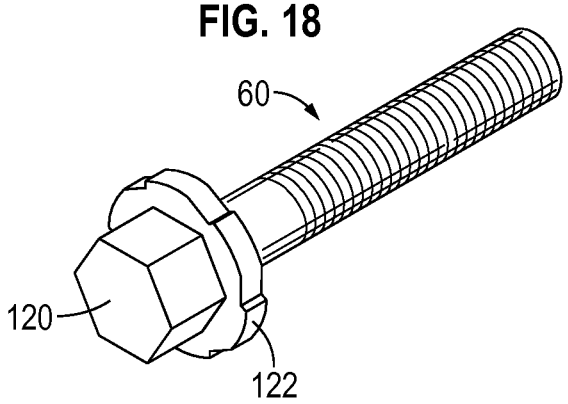
FIG. 18 is an orthogonal view of another example of a threaded fastener for use with a back off preventer, according to an embodiment of the disclosure.
Figure 19:
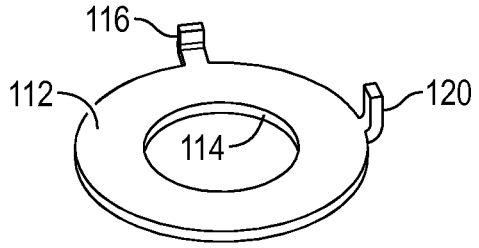
FIG. 19 is an illustration of another example of a back off preventer which may be employed to secure the threaded fastener illustrated in FIG. 18, according to an embodiment of the disclosure.

Referring generally to FIGS. 18 and 19, an embodiment of fastener 60 (see FIG. 18) and corresponding back off preventer 70 (see FIG. 19) is illustrated. In this example, the back off preventer 70 comprises a locking plate 112 which may be in the form of a washer having an opening 114 through which fastener 60 is inserted to couple the cable protector 38 to the corresponding well tubing 34. The locking plate 112 may further comprise a key 116 and a locking member 118, e.g. locking tab. In this example, the fastener 60 may be a threaded fastener with a head 120 to which a suitable tool may be coupled when assembling the cable protector 38 to tubing 34. As illustrated, the fastener 60 also may comprise a ratchet flange 122 which is configured to interact with locking member 118 in a manner which prevents unwanted back off of threaded fastener 60.

Figure 20:
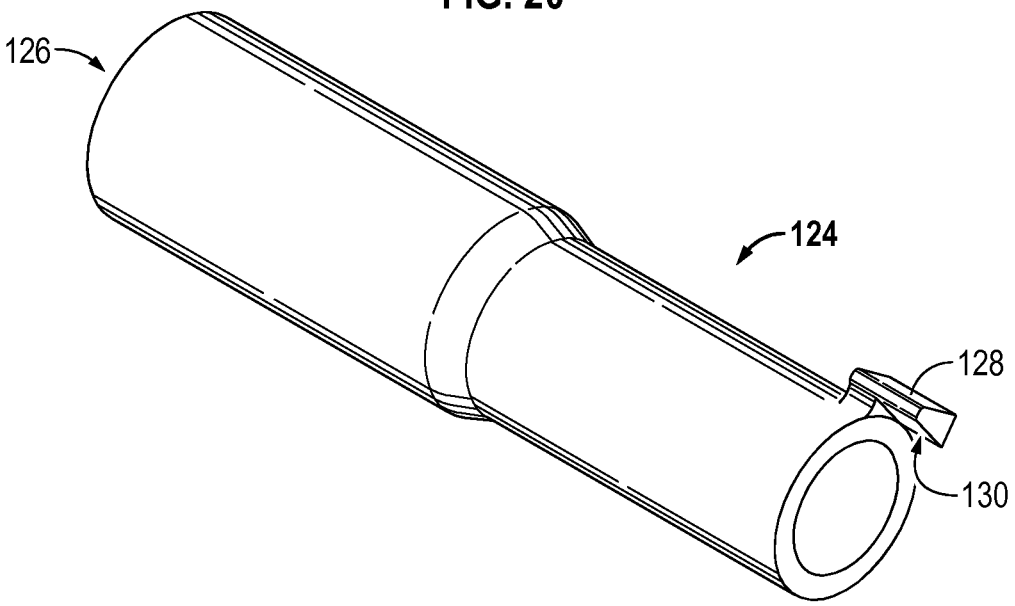
FIG. 20 is an illustration of a socket tool which may be used to set the back off preventer illustrated in FIG. 19, according to an embodiment of the disclosure.
Figure 21:
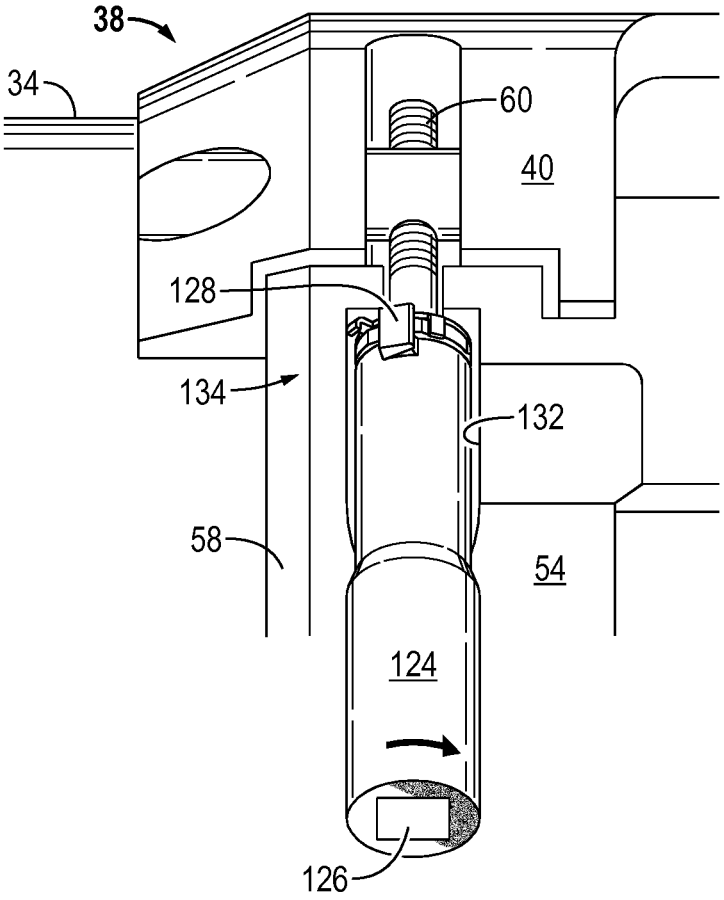
FIG. 21 is an embodiment of a cable protector in which the socket tool illustrated in FIG. 20 is used to set the back off preventer in engagement with the threaded fastener, according to an embodiment of the disclosure.

Referring generally to FIGS. 20 and 21, an embodiment of a socket tool 124 is illustrated. The socket tool 124 comprises a wrench end 126 constructed to receive a suitable tool, such as a socket driver. The socket tool 124 further comprises an extension 128 positioned for engagement with lock member 118 of locking plate 112 once the cable protector 38 is assembled to well tubing 34. The extension 128 also comprises an engagement surface 130, e.g. a beveled engagement surface, positioned to engage and selectively deform the lock member 118.

Figure 22:
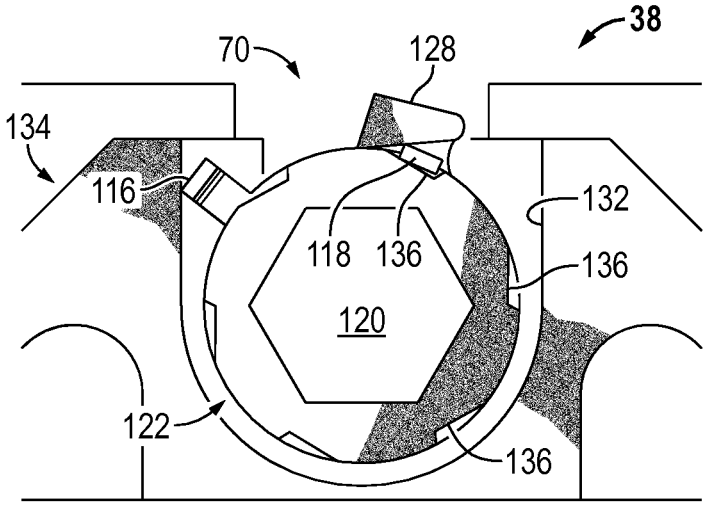
FIG. 22 is an embodiment of the threaded fastener in which a locking tab of the back off preventer has been forced into engagement with the threaded fastener to prevent backing off of the threaded fastener, according to an embodiment of the disclosure.

The locking plate 112 is preinstalled with the threaded fastener 60 such that the lock member/tab 118 extends laterally over the ratchet flange 122. When the threaded fastener 60 is tightened during fastening of cable protector 38 to well tubing 34, the key 116 is located in a recess 132 formed in a collar region 134 of, for example, body 58 of tubing coupling 54. After properly torquing the threaded fastener 60, the socket 124 is slid over the head 120 of fastener 60 such that extension 128 is positioned within recess 132 proximate lock member 118, as illustrated in FIG. 21. The socket 124 is then rotated so that the engagement surface/bevel 130 of extension 128 transfers a radial load to the lock member 118 of locking plate 112. The radial load plastically deforms the lock member 118 into a ratchet groove 136 of ratchet flange 122, as illustrated in FIG. 22. The lock member 118 thus locks the threaded fastener 60 in place and prevents the fastener 60 from backing off and loosening.

Because the locking plate 112 is pre-installed on threaded fastener 60, a one-piece assembly is effectively provided and enables an easy to operate construction. The socket 124 may be constructed for compatibility with available torque wrenches and pneumatic wrenches. In some applications, the threaded fastener 60 may be uninstalled by rotating the fastener 60 in a tightening direction until the ratchet flange 122 forces the lock member 118 radially outward. Once the lock member 118 is sufficiently deformed in a radially outward direction, the threaded fastener 60 may be rotated in a loosening direction to enable removal of the cable protector 38.

It should be noted that various numbers and configurations of the cable protector 38 may be used in many types of tubing applications, including well and non-well related applications. Additionally, the cable protector 38 may comprise other and/or additional components. Depending on the specifics of a given application, the size and structure of the protector shell, removable insert, tubing coupling, threaded fastener, and/or back off preventer may be adjusted. Similarly, several types of materials and manufacturing techniques may be employed to construct the various components of the cable protector.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:
a well tubing;
a cable deployed along the well tubing; and
a cable protector securing the cable to the well tubing, the cable protector comprising:
a protector shell positioned over the cable;
a removable insert positioned within the protector shell, the removable insert comprising a plurality of extensions defining at least one gap therebetween for grippingly receiving the cable;
a tubing coupling to secure the protector shell to the well tubing, wherein the tubing coupling is secured in place about the well tubing by a threaded fastener; and
a malleable backoff preventer engaging the threaded fastener, wherein the malleable backoff preventer is configured to be deformed into a position which prevents the threaded fastener from backing off.

2. The system as recited in claim 1, wherein the removable insert is replaceable with another removable insert having the plurality of extensions located at a different spacing to grippingly receive a differently sized cable.

3. The system as recited in claim 1, wherein the malleable back off preventer comprises amalleable tail secured to the threaded fastener.

4. The system as recited in claim 1, wherein the malleable back off preventer comprises a gripping feature positioned to engage the threaded fastener.

5. The system as recited in claim 1, wherein the protector shell is a casting.

6. The system as recited in claim 1, wherein the removable insert is held within a slot formed in the interior of the protector shell.

7. A system, comprising:
a cable protector having a protector shell and a plurality of tubing couplings engaging the protector shell, the protector shell having a cavity sized to receive a removable cable holding insert, the removable cable holding insert comprising a plurality of extensions spaced to provide cable gripping capability;
a threaded fastener for each of the plurality of tubing couplings configured to secure the cable protector about a tubing; and
a malleable backoff preventer engageable with the threaded fastener of each of the plurality of tubing couplings to prevent release of the threaded fasterner once the cable protector is secured about the tubing, wherein the malleable backoff preventer is configured to be deformed malleably to a position that inhibiis the threaded fasterner from backing off.

8. The system as recited in claim 7, further comprising a cable gripped between the plurality of extensions.

9. The system as recited in claim 8, wherein the cable comprises an electrical communication line.

10. The system as recited in claim 8, wherein the cable comprises a hydraulic conduit.

11. The system as recited in claim 8, wherein the protector shell comprises a plurality of the cavities for receiving a plurality of the removable cable holding inserts.

12. A method, comprising:
selecting a removable insert having a gap sized to enable engagement of a cable inserted into the gap;
assembling a cable protector by placing the removable insert into a protector shell;
inserting the cable into the gap;
securing the cable protector to a tubing via a tubing coupling via a fastener; and
deforming a malleable backoff preventer into a shape that impedes the fastener from backing off.

13. The method as recited in claim 12, wherein assembling comprises placing a plurality of the removable inserts into the protector shell.

14. The method as recited in claim 13, further comprising running the tubing and the cable protector downhole into a wellbore.

* * * * *